US011364173B2

(12) United States Patent
Smith

(10) Patent No.: US 11,364,173 B2
(45) Date of Patent: Jun. 21, 2022

(54) CUSTOMIZABLE MASSAGE DEVICE

(71) Applicant: Lucas Smith, Lakewood, OH (US)

(72) Inventor: Lucas Smith, Lakewood, OH (US)

( * ) Notice: Subject to any disclaimer, the term of this patent is extended or adjusted under 35 U.S.C. 154(b) by 229 days.

(21) Appl. No.: 16/882,464

(22) Filed: May 23, 2020

(65) Prior Publication Data

US 2021/0361518 A1 Nov. 25, 2021

(51) Int. Cl.

| | |
|---|---|
| ***A61H 7/00*** | (2006.01) |
| ***A61H 15/00*** | (2006.01) |
| ***A61H 15/02*** | (2006.01) |

(52) U.S. Cl.

CPC ..... *A61H 7/001* (2013.01); *A61H 15/0078* (2013.01); *A61H 15/02* (2013.01); *A61H 2201/0119* (2013.01); *A61H 2201/105* (2013.01); *A61H 2201/1215* (2013.01); *A61H 2201/501* (2013.01)

(58) Field of Classification Search

CPC .... A61H 7/001; A61H 15/0078; A61H 15/02; A61H 1/00; A61H 23/0263; A61H 23/0254

See application file for complete search history.

(56) References Cited

U.S. PATENT DOCUMENTS

| | | | | |
|---|---|---|---|---|
| 6,228,103 | B1 * | 5/2001 | Grey | A61H 39/04 601/107 |
| 2006/0258962 | A1 * | 11/2006 | Kopanic | A61H 23/0263 601/57 |
| 2013/0041296 | A1 * | 2/2013 | Tass | A61F 7/00 601/46 |
| 2018/0168913 | A1 * | 6/2018 | Sedic | A61H 23/0254 |
| 2019/0365598 | A1 * | 12/2019 | Qu | A61H 15/0085 |

* cited by examiner

*Primary Examiner* — Samchuan C Yao
*Assistant Examiner* — Nathan M Le
(74) *Attorney, Agent, or Firm* — The Iwashko Law Firm, PLLC; Lev Ivan Gabriel Iwashko

(57) ABSTRACT

A customizable massage device, including a main body to be disposed on at least a portion of a body of a user, a pressure assembly disposed at a center of the main body to provide pressure to the body of the user in response to a rotation of the pressure assembly, and an adhesive surface circumferentially disposed on a perimeter of a top surface of the main body to connect to the body of the user, such that the adhesive surface prevents the main body falling off the body of the user.

5 Claims, 2 Drawing Sheets

CUSTOMIZABLE MASSAGE DEVICE

BACKGROUND

1. Field

The present general inventive concept relates generally to a massage device, and particularly, to a customizable massage device.

2. Description of the Related Art

Massaging devices are tools utilized to provide comfort to a user by reducing stress and/or relieve muscle tension. Generally, a massage device uses different means to relax muscles, such as applying pressure and/or motions to a body of the user.

However, conventional massage devices are not wireless and/or hands-free due to their considerable size. The lack of a portable and hands-free massage device prevents people who suffer from stress, headaches, and stiffness in muscles from receiving relaxation on a ready basis due to them not having access to a portable massaging device. Also, conventional massage devices are limited in the means of providing the massage.

Therefore, there is a need for a customizable massage device that is portable and hands-free.

SUMMARY

The present general inventive concept provides a customizable massage device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a customizable massage device, including a main body to be disposed on at least a portion of a body of a user, a pressure assembly disposed at a center of the main body to provide pressure to the body of the user in response to a rotation of the pressure assembly, and an adhesive surface circumferentially disposed on a perimeter of a top surface of the main body to connect to the body of the user, such that the adhesive surface prevents the main body falling off the body of the user.

The pressure assembly may include a sensor ball to connect to the body of the user, an elongated member detachably connected at a first end to the sensor ball, and a rotating member detachably connected to a second end of the elongated member to move the elongated member in response to movement of the rotating member.

The sensor ball may be at least one of a hard construction and a soft construction.

The customizable massage device may further include a motor disposed within at least a portion of the main body to move the pressure assembly in response to a rotation of the motor.

The customizable massage device may further include a control unit disposed within at least a portion of the main body to update massage settings based on commands received from at least one external device.

The customizable massage device may further include a liquid dispenser disposed within at least a portion of the main body to dispense a liquid therefrom in response to detection by the liquid dispenser of a moisture level of the main body being less than a predetermined moisture level.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
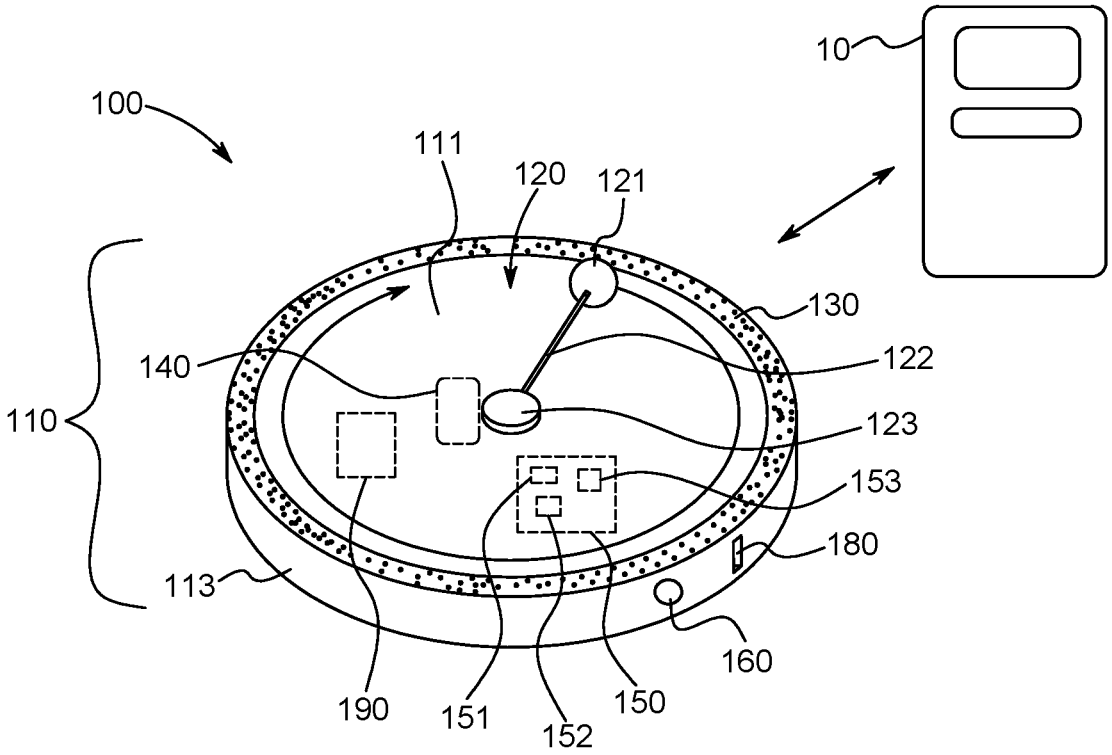
FIG. 1 illustrates a top perspective view of a customizable massage device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Customizable Massage Device 100
Main Body 110
Top Surface 111
Bottom Surface 112
Cylindrical Surface 113
Pressure Assembly 120
Sensor Ball 121
Elongated Member 122
Rotating Member 123
Adhesive Surface 130
Motor 140
Control Unit 150
Processing Unit 151
Communication Unit 152
Storage Unit 153
Button 160
Power Source 170
Power Inlet 180
Liquid Dispenser 190

FIG. 1 illustrates a top perspective view of a customizable massage device 100, according to an exemplary embodiment of the present general inventive concept.

Figure 2:
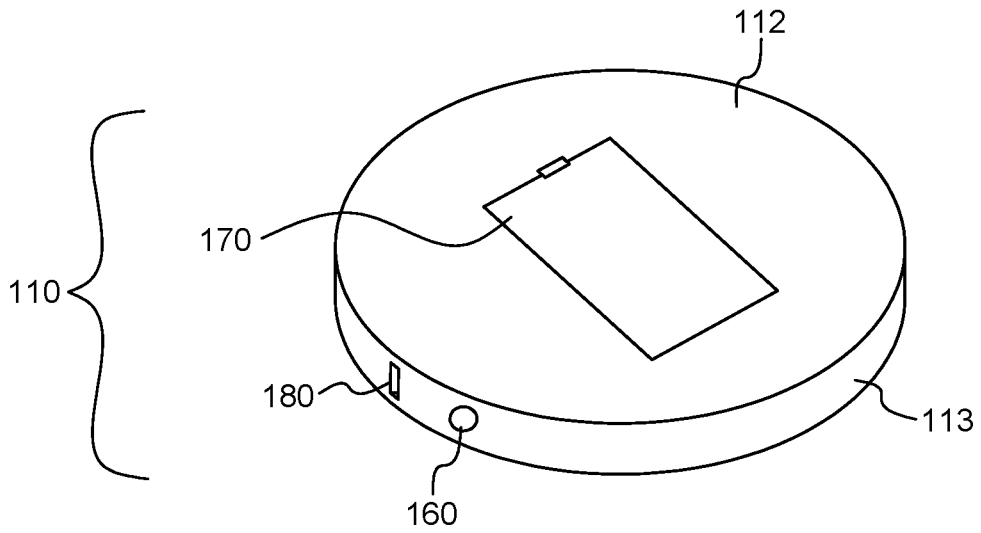
FIG. 2 illustrates a bottom perspective view of the customizable massage device, according to an exemplary embodiment of the present general inventive concept.

FIG. 2 illustrates a bottom perspective view of the customizable massage device 100, according to an exemplary embodiment of the present general inventive concept.

The customizable massage device 100 may be constructed from at least one of metal, plastic, wood, glass, and rubber, etc., but is not limited thereto.

The customizable massage device 100 may include a main body 110, a pressure assembly 120, an adhesive surface 130, a motor 140, a control unit 150, a button 160, a power source 170, a power inlet 180, and a liquid dispenser 190, but is not limited thereto.

Referring to FIGS. 1 and 2, the main body 110 is illustrated to have a cylindrical shape. However, the main body 110 may be a rectangular prism, rectangular, circular, conical, pentagonal, hexagonal, octagonal, or any other shape known to one of ordinary skill in the art, but is not limited thereto.

Moreover, the main body 110 may be constructed to have a predetermined size that is portable. For example, the predetermined size of the main body 110 may be one and a half inches in diameter, such that the main body 110 may be disposed on a head of a user. Also, the main body 110 may be constructed to not exceed a boundary of a face of the user. As such, the predetermined size of the main body 110 may include a range based on a preference and/or a size of the head of the user.

The main body 110 may include a top surface 111, a bottom surface 112, and a cylindrical surface 113, but is not limited thereto.

The top surface 111 may be disposed on a first side of the main body 110. The bottom surface 112 may be disposed on a second side of the main body 110 opposite with respect to the first side of the main body 110. Moreover, a diameter of the top surface 111 may be equivalent to a diameter of the bottom surface 112. Alternatively, the diameter of the top surface 111 may be greater than or less than the diameter of the bottom surface 112 based on the preference of the user.

The cylindrical surface 113 may be circumferentially disposed between the top surface 111 and the bottom surface 112.

The pressure assembly 120 may include a sensor ball 121, an elongated member 122, and a rotating member 123, but is not limited thereto.

The sensor ball 121 may be constructed to be firm and/or soft depending on the preference of the user. In other words, for a firm construction, the sensor ball 121 may remain the same shape despite contacting the user and/or a physical object. Alternatively, for a soft construction, the sensor ball 121 may at least partially deform in response to contacting the user and/or the physical object. As such, the hard construction may provide a deep tissue massage, and the soft construction may provide a soothing and/or relaxation massage.

Furthermore, the sensor ball 121 may have a smooth surface and/or a textured surface, such as a plurality of bubbled protrusions extending away therefrom. Alternatively, the sensor ball 121 may have a plurality of pyramidal shapes and/or a sandpaper-like texture based on the preference of the user.

The top surface 111 of the main body 110 may be disposed on at least a portion of a body of the user, such that the sensor ball 121 may contact at least a portion of the body of the user. For example, the top surface 111 of the main body 110 may be disposed on a head and/or a face of the user, such that the sensor ball 121 may connect to and/or contact the head and/or the face of the user. In other words, the top surface 111 may receive at least a portion of the body of the user thereupon, such that the sensor ball 121 may contact at least a portion of the body of the user.

The elongated member 122 may include a rod, but is not limited thereto.

The elongated member 122 may be detachably connected at a first end to the sensor ball 121 and detachably connected at a second end to the rotating member 123. In other words, the sensor ball 121 may be exchanged for another sensor ball 121 having a different hardness and/or texture based on the preference of the user.

The rotating member 123 may include a gear, but is not limited thereto.

The rotating member 123 may be disposed at a center of the top surface 111.

The sensor ball 121 and/or the elongated member 122 may move in a first direction (i.e. clockwise) or a second direction (i.e. counterclockwise) in response to a rotation of the rotating member 123. In other words, the sensor ball 121 and/or the elongated member 122 may move in a centripetal direction around the top surface 111 of the main body 110.

The adhesive surface 130 may include a glue, a tape, a cement, a mucilage, a paste, an epoxy, but is not limited thereto.

The adhesive surface 130 may be circumferentially disposed on at least a portion of the top surface 111. Specifically, the adhesive surface 130 may be disposed on a perimeter of the top surface 111 away from a center portion of the top surface 111.

The adhesive surface 130 may connect to at least a portion of the body of the user and/or an external surface in response to the top surface 111 of the main body 110 being disposed on the body of the user and/or the external surface. Moreover, the adhesive surface 130 may prevent the main body 110 from falling away from the body of the user. As such, the main body 110 may remain connected to the user and/or the external surface without additional support from the user, such as hands of the user.

However, a surface tension of the adhesive surface 130 may yield to a predetermined force level moving away from the body of the user and/or the external surface. In other words, the main body 110 may be removed from the body of the user and/or the external surface in response to pushing and/or pulling of the main body 110 by the user.

The motor 140 may include a direct current (DC) motor, but is not limited thereto.

The motor 140 may be disposed within at least a portion of the main body 110, and may be mechanically and/or electrically connected to the rotating member 123. As such, the rotating member 123 may rotate in response to a rotation of the motor 140.

Therefore, the pressure assembly 120 may move over at least a portion of the body of the user where the sensor ball 121 is connected, such that stress and/or muscle tension of the user may be reduced. In other words, the pressure assembly 120 may provide pressure to at least a portion of the body of the user in response to the rotation of the pressure assembly 120.

The control unit 150 may include a processing unit 151, a communication unit 152, and a storage unit 153, but is not limited thereto.

The control unit 150 may be disposed within at least a portion of the main body 110.

The processing unit 151 (or central processing unit, CPU) may include electronic circuitry to carry out instructions of a computer program by performing basic arithmetic, logical, control and input/output (I/O) operations specified by the instructions. The processing unit 151 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit 151 may also include a microprocessor and a microcontroller.

The communication unit 152 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, Firewire, and Ethernet.

The storage unit 153 may include a random access memory (RAM), a read-only memory (ROM), a hard disk, a flash drive, a database connected to the Internet, cloud-based storage, Internet-based storage, or any other type of storage unit.

The storage unit 153 may be preprogrammed with a massage software application. For ease of description, the massage software application will be hereinafter referred to as an app.

The processing unit 151 may execute the app to send a command to the motor 140, such that the motor 140 moves in response to the command from the processing unit 151.

Additionally, the control unit 150 may connect and/or communicate with at least one external device 10.

The processing unit 151 may receive additional commands from the at least one external device 10 via the communication unit 152. In other words, the at least one external device 10 may also have the app stored thereon. Moreover, the storage unit 153 may receive updated massage settings based on instructions sent from the at least one external device. For example, the storage unit 153 may receive an update to a time duration and/or a pressure setting, such as ten minutes, twenty minutes, and thirty minutes, as well as a light level, a medium level, and a hard level, respectively.

Specifically, the light level may represent a slow rotation of the pressure assembly 120 that is less than the rotation of the medium level and/or the hard level. The hard level may be a fast rotation of the pressure assembly that is greater than the rotation of the light level and/or the medium level. Also, the light level, the medium level, and/or the hard level may be based on revolutions per minute (RPM) of the pressure assembly 120 over the top surface 111.

The button 160 may include a button, a lever, and a switch, but is not limited thereto.

The button 160 may be disposed on at least a portion of the cylindrical surface 113.

Referring to FIG. 2, the power source 170 is illustrated to be a battery compartment that stores a battery therein. However, the power source 170 may be a solar cell and/or any other power source known to one of ordinary skill in the art.

The power inlet 180 may include a universal serial bus (USB) port and an alternating current (AC) port, but is not limited thereto.

The power inlet 180 may be disposed on at least a portion of the cylindrical surface 113. The power inlet 180 may connect to an external power outlet via a power cord to receive power therein. As such, the power inlet 180 may charge the power source 170.

The liquid dispenser 190 may include a moisture sensor, a liquid container, and a liquid outlet, but is not limited thereto.

The liquid dispenser 190 may be disposed within at least a portion of the main body 110. The moisture sensor may detect a moisture level on the top surface 111 and/or the pressure assembly 120. The liquid container may store a liquid, such as a massage oil and/or a lubricant therein. The liquid outlet may dispense the liquid from the liquid container in response to the moisture sensor detecting the moisture level below a predetermined moisture level. More specifically, the moisture sensor may move a door over the liquid outlet, such that the liquid may flow from the liquid container out through the liquid outlet.

As such, the liquid dispenser 190 may dispense the liquid on the top surface 111, the body of the user, and/or the external surface. Accordingly, the liquid dispenser 190 may enhance a relaxation of the user.

The button 160 may be used to turn on and/or turn off the pressure assembly 120, the motor 140, the control unit 150, and/or the liquid dispenser 190.

Furthermore, the power source 170 and/or the power inlet 180 may send power to the pressure assembly 120, the motor 140, the control unit 150, the button 160, and/or the liquid dispenser 190.

Therefore, the customizable massage device 100 may massage the user without requiring the hands of the user to remain on the body of the user. Additionally, the customizable massage device 100 may be customized based on the preference of the user.

The present general inventive concept may include a customizable massage device 100, including a main body 110 to be disposed on at least a portion of a body of a user, a pressure assembly 120 disposed at a center of the main body 110 to provide pressure to the body of the user in response to a rotation of the pressure assembly 120, and an adhesive surface 130 circumferentially disposed on a perimeter of a top surface of the main body 110 to connect to the body of the user, such that the adhesive surface 130 prevents the main body falling off the body of the user.

The pressure assembly 120 may include a sensor ball 121 to connect to the body of the user, an elongated member 122 detachably connected at a first end to the sensor ball 121, and a rotating member 123 detachably connected to a second end of the elongated member 122 to move the elongated member 122 in response to movement of the rotating member 123.

The sensor ball 121 may be at least one of a hard construction and a soft construction.

The customizable massage device 100 may further include a motor 140 disposed within at least a portion of the main body 110 to move the pressure assembly 120 in response to a rotation of the motor 140.

The customizable massage device 100 may further include a control unit 150 disposed within at least a portion of the main body 150 to update massage settings based on commands received from at least one external device 10.

The customizable massage device 100 may further include a liquid dispenser 190 disposed within at least a portion of the main body 110 to dispense a liquid therefrom in response to detection by the liquid dispenser 190 of a moisture level of the main body 110 being less than a predetermined moisture level.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A customizable massage device, comprising:

a main body to be disposed on at least a portion of a body of a user;

a pressure assembly disposed at a center of the main body to provide pressure to the body of the user in response to a rotation of the pressure assembly;

an adhesive surface circumferentially disposed on a perimeter of a top surface of the main body to connect to the body of the user, such that the adhesive surface prevents the main body falling off the body of the user;

a sensor is disposed on the top surface of the main body; and wherein the pressure assembly comprises:

a ball to connect to the hod of the user;

an elongated member detachably connected at a first end to the ball; and a rotating member detachably connected to a second end of the elongated member to move the elongated member in response to movement of the rotating member; and wherein the ball and the elongated member move in a circular direction around the top surface of the main body.

2. The customizable massage device of claim 1, wherein the ball is at least one of a hard construction and a soft construction.

3. The customizable massage device of claim 1, further comprising:

a motor disposed within at least a portion of the main body to move the pressure assembly in response to a rotation of the motor.

4. The customizable massage device of claim 1, further comprising:

a control unit disposed within at least a portion of the main body to update massage settings based on commands received from at least one external device.

5. The customizable massage device of claim 1, further comprising: a liquid dispenser disposed within at least a portion of the main body to dispense a liquid therefrom in response to detection by the sensor of the liquid dispenser of a moisture level of the main body being less than a predetermined moisture level.

* * * * *